United States Patent [19]

Schulze-Berge

[11] Patent Number: 4,550,572

[45] Date of Patent: Nov. 5, 1985

[54] ICE MACHINE ANTI-BLOCK CONTROL

[75] Inventor: Carl J. Schulze-Berge, Manitowoc, Wis.

[73] Assignee: The Manitowoc Company, Inc., Manitowoc, Wis.

[21] Appl. No.: 635,157

[22] Filed: Jul. 27, 1984

[51] Int. Cl.[4] ..... F25C 1/12

[52] U.S. Cl. ..... 62/138; 62/158; 62/233

[58] Field of Search ..... 62/138, 158, 233

[56] References Cited

U.S. PATENT DOCUMENTS

| | | | |
|---|---|---|---|
| 2,322,405 | 6/1943 | White | 236/11 |
| 3,045,445 | 7/1962 | MacLeod | 62/158 X |
| 3,046,754 | 7/1962 | Kniffin | 62/158 X |

*Primary Examiner*—William E. Tapolcai

*Attorney, Agent, or Firm*—Leydig, Voit & Mayer, Ltd.

[57] ABSTRACT

An ice machine control having an on-delay timer in the circuit controlling the circulating water pump so that, at the start of an ice making cycle, the evaporator-ice mold is allowed to cool well below freezing before water begins to circulate to the mold.

4 Claims, 2 Drawing Figures

ICE MACHINE ANTI-BLOCK CONTROL

This invention relates generally to ice making machines and more particularly concerns a control for avoiding water flow blockage.

A compression refrigeration ice maker has evaporator coils in close thermal contact with the ice forming mold. During the ice making cycle, refrigerant is evaporated in the coils to cool the mold well below freezing, and water is pumped over the mold to build up the desired ice forms.

After the ice has been formed, a typical ice maker goes into a harvest cycle in which water circulation is interrupted and hot gas from the compressor is directed through the evaporator coils to heat the mold and thus free the formed ice. After the harvest cycle, water circulation is resumed and the mold is again chilled to initiate a new ice making cycle.

At the start of an ice making cycle, mold temperature drops through water freezing temperature to the well-below freezing temperature at which ice is formed. Water circulating over the mold is not frozen at the very start of the cycle. Soon, however, ice crystals are formed in the circulating water creating an icy slush, and finally the mold reaches the low temperature at which ice clings to the mold and the desired ice form is built up. During the time ice crystals and the resulting slush are created, the ice crystals can clog and dam up the water circulation system resulting in water overflow or a condition in which water does not reach the pump, thus starving the pump.

It is found that this problem becomes greater as improvements are made in the refrigeration system to obtain faster freezing. Increased cooling capacity apparently causes a greater volume of ice crystals to be initially formed and washed into the water circulation system.

Accordingly, it is the primary aim of the invention to provide a control for avoiding the initial formation of icy sludge at the start of an ice making cycle.

Another object of the invention is to provide a control as characterized above that is simple and economical. A related object is to provide such a control that can be easily understood by the user of an ice making machine and easily adjusted for proper operation.

Other objects and advantages of the invention will become apparent upon reading the following detailed description and upon reference to the drawings, in which.

Figure 1:
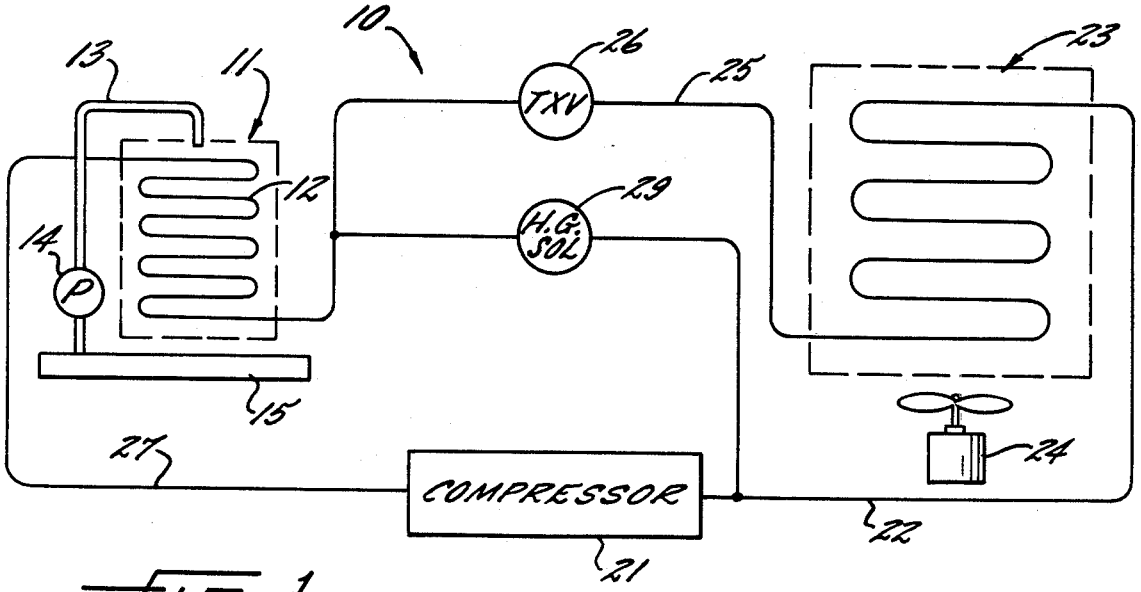
FIG. 1 is a schematic of the refrigeration system in an ice making machine.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Turning to the drawing, there is schematically shown an ice making machine 10 having an ice mold 11 cooled by evaporator coils 12 and supplied with water by a circulation system including a pipe 13, pump 14 and trough or sump 15. The refrigeration system supplying evaporating refrigerant to the coils 12 includes a compressor 21, discharge line 22, condensor 23 and fan 24, feed line 25 and expansion valve 26. During the ice making cycle, gas from a return line 27 is compressed by the compressor 21, cooled to liquid state in the condensor 23, and, controlled by the expansion valve 26, the refrigerant evaporates in the evaporator coils 12 bringing the mold temperature well below freezing. As a result, water delivered by the pump 14 flows over the mold 11 building up the ice forms shaped by the mold.

At the end of the ice making cycle, the pump 14 is stopped and hot gas is directed through a hot gas solenoid valve 29 so as to heat the mold 11 and free the formed ice. Once the ice is harvested, the ice making cycle is started again.

Figure 2:
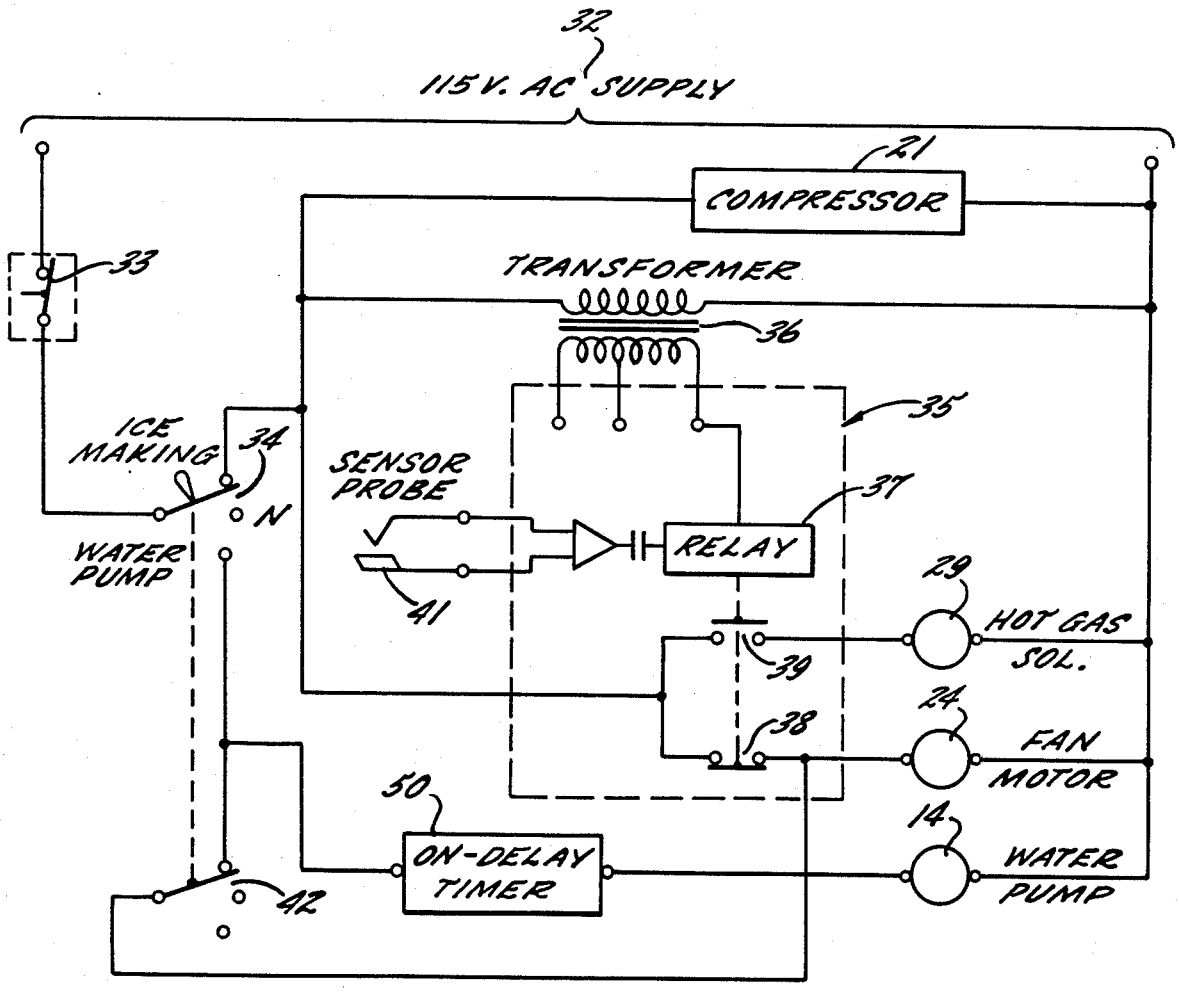
FIG. 2 is a schematic of a control system for the system of FIG. 1 embodying the invention.

The control circuit of FIG. 2 is shown in the ice making cycle position of the components. Current from a supply 32 passes through a closed harvest switch 33 and contacts of a manual switch 34 to operate the compressor 21 and energize a control circuit 35 through a transformer 36. The circuit 35 includes a relay 37, operating contacts 38 and 39, which is controlled by an ice sensing probe 41. In the ice making cycle, both the fan 24 and the water pump 14 are energized through the contacts 38 and, in the case of the pump 14, a second set of contacts 42 of the manual switch 34.

When the probe 41 detects completion of the ice making, the relay 37 is energized opening contacts 38, thereby stopping the fan 24 and the pump 14, and closing the contacts 39 so as to energize the solenoid valve 29. When the ice is released signifying the end of the harvest cycle, the released ice briefly opens switch 33 which momentarily deenergizes the entire circuit including dropping out relay 37 to restore the contacts 38 and 39 to the illustrated position. When the switch 33 closes, the ice making cycle restarts.

U.S. application Ser. No. 461,122, filed Jan. 26, 1983, assigned to the assignee of the present application, discloses the physical structure of the switch 33 and probe 41 in greater detail, and is specifically incorporated herein by reference.

In accordance with the invention, a delay device 50 in the form of an on-delay switch is interposed in the pump switch control. In an actual ice making machine of the commercial type, the switch 50 delays transmission of current for an adjustable period of time, from 0 to 45 seconds. It has been found that a 20 second delay permits the refrigeration system to cool down the mold 11 well below freezing at the start of an ice making cycle before closing of the switch 50 energizes the pump 14 to deliver water. As a result, when water starts circulating over the mold 11, ice build-up starts immediately and there is no stage of forming ice crystals that are washed away resulting in an icy sludge in the sump 15 that could dam or block the water circulation system.

It will be appreciated that the inclusion of the delay switch 50 is a simple and economical addition to the ice making control circuit. Further, a user of the equipment can easily visualize the effect of setting the device 50 and hence that portion of the control circuit can be easily adjusted for proper operation.

I claim as my invention:

1. In an ice making machine having an evaporator and ice mold, a water circulation system including a pump for circulating water over the mold during an ice making cycle, a circuit for stopping the pump at the end of an ice making cycle to initiate an ice harvesting cycle, and a circuit for starting the pump at the end of an ice harvesting cycle to initiate the next ice making cycle, the improvement comprising, a delay device in said circuit for starting the pump so that the ice making cycles start with a period for cooling the evaporator and mold before water is circulated over the mold.

2. The combination of claim 1 in which said ice machine includes means for heating the mold during an ice harvesting cycle.

3. The combination of claim 1 in which said ice machine includes a compressor and a condensor to circulate refrigerant to said evaporator during ice making cycles.

4. The combination of claim 1 in which said delay device is an on-delay switch that is manually adjusted for its delay time.

* * * * *